US008942605B2

(12) United States Patent
Nakano

(10) Patent No.: US 8,942,605 B2
(45) Date of Patent: Jan. 27, 2015

(54) IMAGE FORMING APPARATUS

(71) Applicant: Hiroshi Nakano, Nagoya (JP)

(72) Inventor: Hiroshi Nakano, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 134 days.

(21) Appl. No.: 13/626,260

(22) Filed: Sep. 25, 2012

(65) Prior Publication Data

US 2013/0101322 A1 Apr. 25, 2013

(30) Foreign Application Priority Data

Oct. 19, 2011 (JP) ..... 2011-229725

(51) Int. Cl.
*G03G 15/16* (2006.01)
*G03G 15/01* (2006.01)

(52) U.S. Cl.
CPC ..... *G03G 15/1615* (2013.01); *G03G 15/0194* (2013.01); *G03G 2215/0119* (2013.01); *G03G 2215/0177* (2013.01); *G03G 15/0131* (2013.01); *G03G 15/1605* (2013.01); *G03G 15/161* (2013.01); *G03G 2215/0141* (2013.01)
USPC ..... 399/302; 399/303

(58) Field of Classification Search
CPC ..... G03G 15/00
USPC ..... 399/302–303
See application file for complete search history.

(56) References Cited

U.S. PATENT DOCUMENTS 5,150,165 A * 9/1992 Asai ..... 399/297
6,453,143 B2 * 9/2002 Takeuchi ..... 399/303
7,567,775 B2 * 7/2009 Fukuhara ..... 399/302
8,095,054 B2 * 1/2012 Nakamura ..... 399/302
8,414,991 B2 * 4/2013 Suzuki et al. ..... 428/36.8
8,515,322 B2 * 8/2013 Inaba et al. ..... 399/302
2002/0003977 A1 * 1/2002 Kanekura et al. ..... 399/302
2007/0183819 A1 * 8/2007 Kishi ..... 399/302
2008/0019741 A1 * 1/2008 Lee et al. ..... 399/302
2010/0247171 A1 * 9/2010 Ono et al. ..... 399/302
2010/0316419 A1 * 12/2010 Nakamura ..... 399/302
2011/0049795 A1 3/2011 Yamaguchi
2011/0206399 A1 * 8/2011 Fujita et al. ..... 399/49

(Continued)

FOREIGN PATENT DOCUMENTS

JP HEI 08-160777 A 6/1996
JP HEI 10-104969 A 4/1998

(Continued)

*Primary Examiner* — Clayton E Laballe
*Assistant Examiner* — Kevin Butler
(74) *Attorney, Agent, or Firm* — Scully, Scott, Murphy & Presser, P.C.

(57) ABSTRACT

An endless belt is held by a first roller and a second roller each having an axis extending in an axial direction. A transfer member is disposed opposite to an image supporting member with the belt therebetween. The transfer member is configured to transfer a developer image supported by the image supporting member to a sheet conveyed by the belt. The image supporting member extends in the axial direction. The belt and the transfer member each have a width in a direction parallel to the axial direction. A first portion of the image supporting member and a first portion of the transfer member directly oppose each other without the belt therebetween. A second portion of the image supporting member opposes a first surface of the belt, and a second portion of the transfer member opposes a second surface of the belt, which is opposite to the first surface.

12 Claims, 10 Drawing Sheets

(56) References Cited

U.S. PATENT DOCUMENTS

| | | | | |
|---|---|---|---|---|
| 2011/0274472 | A1* | 11/2011 | Inaba et al. | 399/302 |
| 2013/0164049 | A1* | 6/2013 | Kawanami et al. | 399/302 |

FOREIGN PATENT DOCUMENTS

| | | | | |
|---|---|---|---|---|
| JP | 2009-265421 | * | 11/2009 | G03G 15/00 |
| JP | 2011-053460 | A | 3/2011 | |

* cited by examiner

IMAGE FORMING APPARATUS

CROSS REFERENCE TO RELATED APPLICATION

This application claims priority from Japanese Patent Application No. 2011-229725, filed on Oct. 19, 2011, the entire disclosure of which is incorporated herein by reference.

BACKGROUND OF THE INVENTION

1. Field of the Invention

The present invention relates to an electrophotographic image forming apparatus in which a developer image is transferred onto a sheet.

2. Description of Related Art

A known image forming apparatus comprises a transfer belt configured to convey a sheet, a photosensitive drum configured to support a developer image, and a transfer roller configured to transfer the developer image to the sheet. The photosensitive drum is disposed on one side of the transfer belt, and the transfer roller is disposed on the other side of the transfer belt so as to oppose the photosensitive drum with the transfer belt therebetween.

A dimension in a width direction of the transfer belt is set to be substantially equal to a dimension in an axial direction of the transfer roller and a dimension in an axial direction of the photosensitive drum. The transfer roller and the photosensitive drum oppose each other with the transfer belt therebetween. The transfer belt lies substantially throughout the dimensions in the axial directions of the transfer roller and the photosensitive drum.

The dimension in the width direction refers to a direction parallel to the directions in the axial directions of the transfer roller and rollers for holding the transfer belt. The dimension in the axial direction of the photosensitive drum or the transfer roller refers to a dimension in the axial direction of a portion of the photosensitive drum or the transfer roller that directly involves in image forming. Thus, the dimension in the axial direction of the photosensitive drum refers to a dimension in the axial direction of an irradiation area of the photosensitive drum. The dimension in the axial direction of the transfer roller refers to a dimension in the axial direction of a portion of the transfer roller that corresponds to the irradiation area.

SUMMARY OF THE INVENTION

According to an embodiment of the invention, an image forming apparatus comprises a first roller configured to rotate about an first axis extending in an axial direction, a second roller configured to rotate about a second axis extending in the axial direction, a belt held by the first roller and the second roller and configured to convey a sheet, an image supporting member extending in the axial direction and configured to support a developer image, and a transfer member disposed on an opposite side of the belt from the image supporting member and configured to transfer the developer image supported by the image supporting member to the sheet conveyed by the belt. The belt is endless, has a first surface and a second surface opposite to the first surface, and has a width in a direction parallel to the axial direction. The transfer member has a width in a direction parallel to the axial direction. A first portion of the image supporting member and a first portion of the transfer member oppose each other directly without the belt therebetween. A second portion of the image supporting member opposes the first surface of the belt, and a second portion of the transfer member opposes the second surface of the belt.

According to another embodiment of the invention, an image forming apparatus comprises a first roller configured to rotate about an first axis extending in an axial direction, a second roller configured to rotate about a second axis extending in the axial direction, a belt held by the first roller and the second roller and configured to convey a sheet, a first image supporting member extending in the axial direction and configured to support a first developer image, and a first transfer member disposed on an opposite side of the belt from the first image supporting member and configured to transfer the first developer image supported by the first image supporting member to the sheet conveyed by the belt, a second image supporting member extending in the axial direction and configured to support a second developer image, and a second transfer member disposed on an opposite side of the belt from the second image supporting member and configured to transfer the second developer image supported by the second image supporting member to the sheet conveyed by the belt. The belt is endless, has a first surface and a second surface opposite to the first surface, and has a width in a direction parallel to the axial direction. The first transfer member and the second transfer member each have a width in a direction parallel to the axial direction. A first portion of the first image supporting member and a first portion of the first transfer member oppose each other directly without the belt therebetween. A second portion of the first image supporting member opposes the first surface of the belt, and a second portion of the first transfer member opposes the second surface of the belt. A first portion of the second image supporting member and a first portion of the second transfer member oppose each other directly without the belt therebetween. A second portion of the second image supporting member opposes the first surface of the belt, and a second portion of the second transfer member opposes the second surface of the belt.

Other objects, features, and advantages will be apparent to persons of ordinary skill in the art from the following detailed description of the invention and the accompanying drawings.

DETAILED DESCRIPTION OF EMBODIMENTS

Embodiments of the invention and their features and technical advantages may be understood by referring to FIGS. 1-10B, like numerals being used for like corresponding parts in the various drawings.

An image forming apparatus, according to a first embodiment of the invention, may be a laser printer of a direct transfer tandem type.

Figure 1:
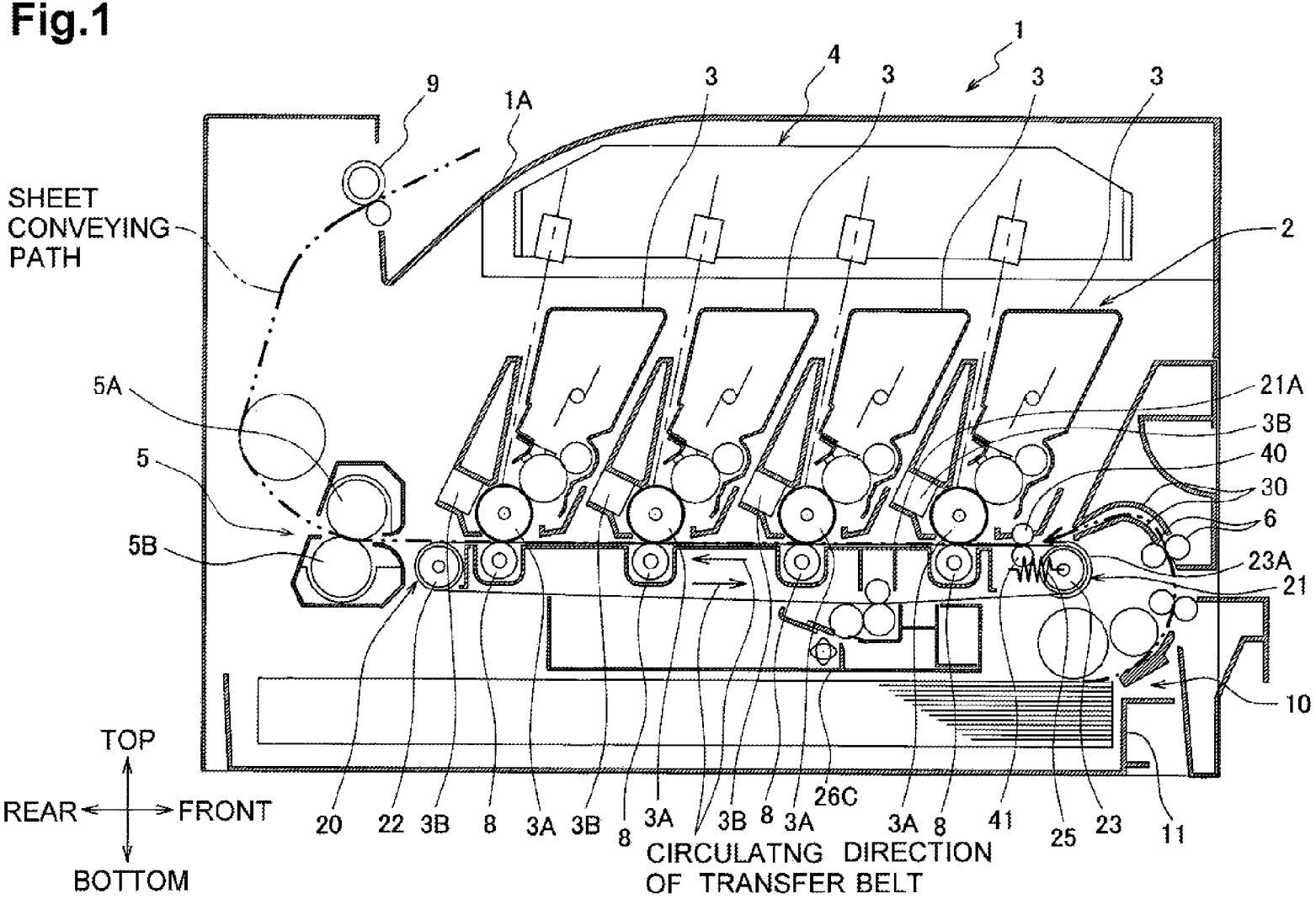
FIG. 1 is a cross-sectional view of an image forming apparatus, according to a first embodiment of the invention, taken along a center line of the apparatus parallel to a front-rear direction.

As shown in FIG. 1, an image forming apparatus 1 comprises therein an image forming unit 2 and a sheet feeder 10. The image forming unit 2 forms an image to be printed on a sheet. The sheet feeder 10 sequentially feeds sheets held on a sheet holder, e.g., a feed tray 11, to the image forming unit 2.

The image forming unit 2 and the sheet feeder 10 are assembled into a main body of the image forming apparatus 1. The main body refers to a portion, e.g., a housing or a frame, that is not dismantled or removed by the user in normal use.

The image forming unit 2 may be an electrophotographic image forming unit comprising at least one process cartridge 3, at least one irradiating unit 4, and a single fusing unit 5. In this embodiment, the image forming unit 2 is a color image forming unit and comprises a plurality of process cartridges 3 for a plurality of colors of developers, e.g., black, yellow, magenta, and cyan.

Each process cartridge 3 comprises a photosensitive drum 3A and a charger 3B. The photosensitive drum 3A supports, as an image supporting member, a developer image to be transferred to a sheet. The charger 3B charges an irradiation area on a circumferential surface of the photosensitive drum 3A.

When the irradiating unit 4 irradiates the charged irradiation area of the photosensitive drum 3A, an electrostatic latent image is formed on the irradiation area. Then when a charged developer is supplied to the photosensitive drum 3A, a developer image is formed and supported on the irradiation area of the photosensitive drum 3A.

A transfer belt 21 is an endless belt that conveys a sheet fed from the feed tray 11 to the photosensitive drums 3A. The photosensitive drums 3A are arranged side by side along a moving direction of the transfer belt 21 so as to be opposite to an extending surface 21A of the transfer belt 21. The extending surface 21A is a flat surface of the transfer belt 21 wound around a driving roller 22 and a driven roller 23 in a tensioned manner.

A transfer member, e.g., a transfer roller 8, is disposed opposite to each of the photosensitive drums 3A with the transfer belt 21 therebetween. The transfer roller 8 extends in a direction parallel to an axial direction of the corresponding photosensitive drum 3A. The transfer roller 8 transfers a developer image supported on the corresponding photosensitive drum 3A to a sheet.

Figure 3:
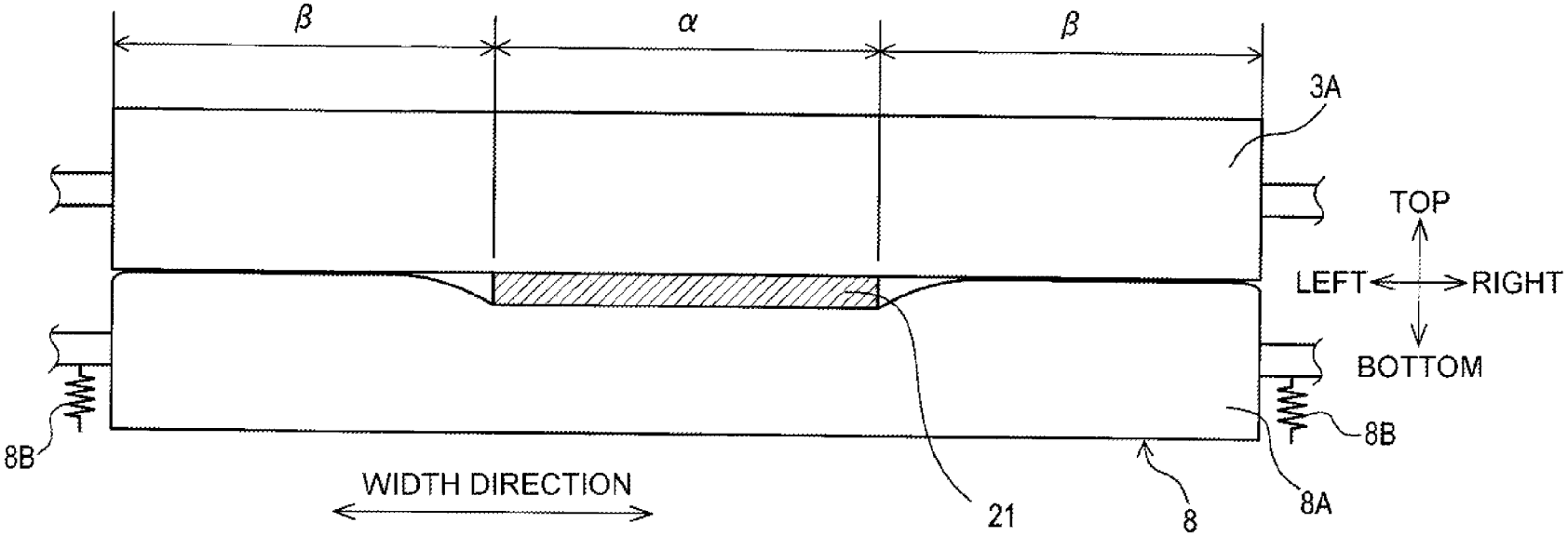
FIG. 3 is a schematic drawing showing an indirectly opposing area in which a photosensitive drum and a transfer roller oppose each other indirectly and a directly opposing area in which the photosensitive drum and the transfer roller oppose each other directly, according to the first embodiment of the invention.

As shown in FIG. 3, the transfer roller 8 comprises an elastic layer 8A, e.g., a sponge, formed on an outer circumferential surface thereof which contacts the transfer belt 21. The transfer roller 8 is urged by urging members 8B, e.g., a spring, so as to press the transfer roller 8 against the corresponding photosensitive drum 3A. The urging members 8B are assembled into a belt frame 24, which will be described below.

A potential having an opposite polarity to that of the charged developer is applied to the transfer roller 8. Thus, the developer image of each color supported on the corresponding photosensitive drum 3A is directly superposed onto the sheet.

As shown in FIG. 1, the sheet fed by the feeder 10 from the feed tray 11 is conveyed via a registration roller pair 6 to the image forming unit 2, i.e., the transfer belt 21. The registration roller pair 6 corrects the orientation of the sheet and feeds the sheet onto the transfer belt 21 at a predetermined timing.

The fusing unit 5 comprises a heat roller 5A that contacts and heats the sheet, and a pressure roller 5B that presses the sheet against the heat roller 5A. A discharge roller 9 discharges the sheet discharged from the fusing unit 5 onto a discharge tray 1A disposed on an upper surface of the main body of the image forming apparatus 1.

A belt unit 20 comprises the transfer belt 21, the driving roller 22, and the driven roller 23. In an embodiment, the belt unit 20 may be removably attached to the main body of the image forming apparatus 1.

The transfer belt 21 is an endless belt made of resin, e.g., a thermoplastic elastomer resin. The transfer belt 21 is held by the driving roller 22 and the driven roller 23 that are disposed substantially parallel to each other in their axial directions. The rotation axis of the driving roller 22 and the rotation axis of the driven roller 23 are parallel to each other.

The axial directions of the driving roller 22 and the driven roller 23 are parallel to the axial directions of the photosensitive drums 3A and the transfer rollers 8. Hereinafter, a direction parallel to the axial directions of the photosensitive drums and rollers 3A, 8, 22, 23, respectively is referred to as "an axial direction" and a direction parallel to the axial direction is also referred to as "a width direction."

In an embodiment, the transfer belt 21 may be a guideless belt. A guideless belt means an endless transfer belt not provided with a guide portion, e.g., a guide rib, that prevents the transfer belt 21 from skewing with respect to the axial direction. The skewing of the transfer belt 21 refers to a phenomenon where the transfer belt 21 moves in the axial direction while circulating.

The driving roller 22 is driven by an electric motor provided in the main body and applies a rotating force to the transfer belt 21. The driven roller 23 is disposed upstream of the driving roller 22 in a sheet conveying direction and is driven to rotate as the transfer belt 21 circulates. The electric motor is omitted from FIG. 1.

Figure 2:
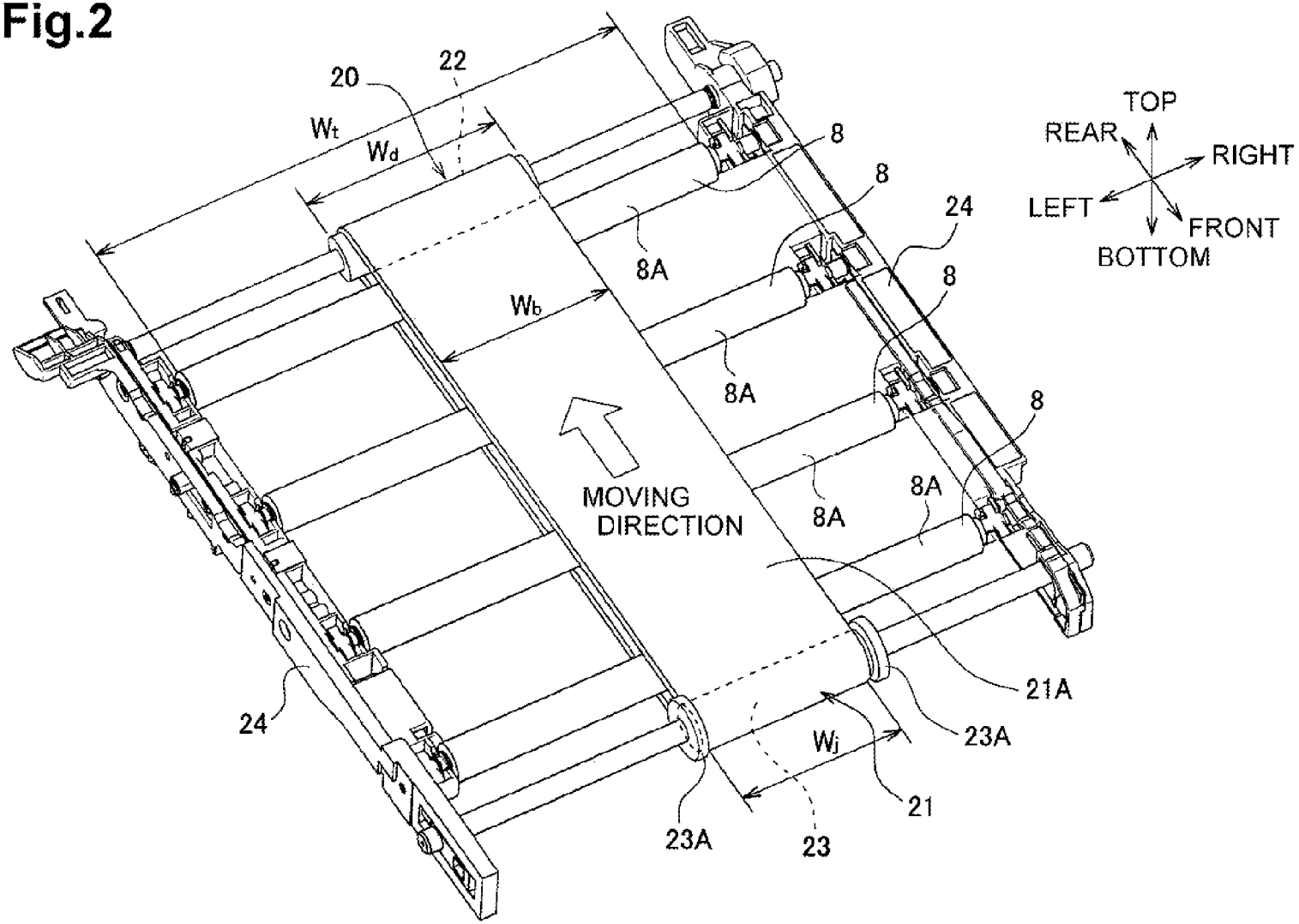
FIG. 2 is a perspective view of a belt unit of the image forming apparatus according to the first embodiment of the invention.

As shown in FIG. 2, opposite ends in the axial direction of each of the driving roller 22 and the driven roller 23 are held by a belt frame 24. The driving roller 22 is immovable relative to the belt frame 24 in an extending direction of the transfer belt 21. The driven roller 23 is movable relative to the belt frame 24 in the extending direction of the transfer belt 21.

The extending direction of the transfer belt 21 is parallel to a direction in which tension is generated on the extending surface 21A. In this embodiment, the extending direction is parallel to a direction directed from the driving roller 22 to the driven roller 23.

As shown in FIG. 1, the driven roller 23 receives an elastic force from an elastic member 25, e.g., a spring, such that the driven roller 23 moves away from the driving roller 22. The elastic member 25 functions as a tension generating member for causing the transfer belt 21 to generate tension on the extending surface 21A. The driven roller 23 functions as a tension roller for causing the transfer belt 21 to generate tension.

The driven roller 23 comprises a pair of flanges 23A protruding outward in a radial direction from a roller portion that contacts the transfer belt 21. As shown in FIG. 2, two flanges 23A are formed around the roller portion so as to sandwich the transfer belt 21 from opposite sides in the width direction.

Each of the flanges 23A faces a corresponding one of widthwise ends of the transfer belt 21 and prevents the transfer belt 21 from skewing with respect to the axial direction. Although the flanges 23A are immovable in the axial direction relative to the roller portion, the flanges 23*a* are rotatable independently from the roller portion.

A dimension Wb in the width direction of the transfer belt 21 is set to be less than a dimension in the width direction of a sheet of the maximum size placeable on the feed tray 11. It is required that dimensions in the axial direction of the photosensitive drum 3A and the transfer roller 8 correspond to the dimension in the width direction of the sheet of the maximum size and are greater than the dimension Wb in the width direction of the transfer belt 21. Thus, the dimension Wb in the width direction of the transfer belt 21 is set to be less than the dimension Wt in the axial direction of the transfer roller 8 (e.g., width of the transfer roller 8).

As long as a dimension Wd in the axial direction of the driving roller 22 and a dimension Wj in the axial direction of the driven roller 23 are great enough to hold the transfer belt 21 therebetween, the dimension Wd and the dimension Wj may be set to be less than the dimension Wt in the axial direction of the transfer roller 8 (e.g., width of the transfer roller 8).

A dimension in the axial dimension of the photosensitive drum 3A refers to a dimension in the width direction of the irradiation area. A dimension in the axial direction of the transfer roller 8 refers to a dimension in the axial direction of an area of the transfer roller 8 corresponding to the irradiation area of the photosensitive drum 3A. The dimension Wd in the axial direction of the driving roller 22 refers to a dimension in the axial direction of the roller portion that contacts the transfer roller 21. The dimension Wj in the axial direction of the driven roller 23 refers to a dimension in the axial direction of the roller portion that contacts the transfer belt 21.

Consequently, as shown in FIG. 3, an indirectly opposing area α and a directly opposing area β are defined in the axial direction. In the indirectly opposing area α, the transfer roller 8 and the photosensitive drum 3A oppose each other indirectly with the transfer belt 21 therebetween. In the directly opposing area β, the transfer roller 8 and the photosensitive drum 3A oppose each other directly without the transfer belt 21 therebetween. In other words, a first portion of the photosensitive drum 3A and a first portion of the transfer roller 8 oppose each other without the transfer belt 21 therebetween. A second portion of the photosensitive drum 3A opposes a first surface of the transfer belt 21, and a second portion of the transfer roller 8 opposes a second surface of the transfer belt 21, which is opposite to the first surface.

In this embodiment, because the sheet is conveyed while being aligned with reference to a center in the axial direction, the transfer belt 21 is disposed at a substantially central portion in the axial direction. Thus, two directly opposing areas β are provided on opposite sides of the indirectly opposing area α in the axial direction.

The transfer belt 21 has a thickness of 160 μm or less. The transfer roller 8 is urged by the urging members 8B such that the transfer roller 8 is pressed against the photosensitive drum 3A, and the elastic layer 8A on the outer circumferential surface of the transfer roller 8 is compressed. In this embodiment, the transfer roller 8 is in contact with the photosensitive drum 3A in the directly opposing area β and is elastically deformed by the transfer belt 21 in the indirectly opposing area α. The transfer roller 8 and the photosensitive drum 3A sandwich the transfer belt 21 therebetween in the indirectly opposing area α. In other words, a first portion of the elastic layer 8A is in contact with the first portion of the photosensitive drum 3A, and a second portion of the elastic layer 8A is elastically deformed by the second surface of the transfer belt 21. Accordingly, a clearance formed between the photosensitive drum 3A and the transfer roller 8 in the directly opposing area β is hardly visually recognized.

In this embodiment, the feed tray 11 is disposed below the belt unit 20. As shown in FIG. 1, a sheet conveying path formed from the feed tray 11 to the transfer belt 21 is curved into a U-shape. The registration roller pair 6 is disposed along the sheet conveying path.

More specifically, a sheet guide 30 is disposed on a discharge side of the registration roller pair 6 to guide the sheet to the transfer belt 21. The sheet guide 30 guides the sheet discharged from the registration roller pair 6 to a position above the extending surface 21A such that the sheet approaches the transfer belt 21 at an acute angle with respect to the extending surface 21A.

In this embodiment, the flanges 23A of the driven roller 23 are disposed on a sheet approaching side of the transfer belt 21. The sheet guide 30 defines a sheet conveying path along which the sheet is guided to a position above the extending surface 21A and more outer in the radial direction of the driven roller 23 than the flanges 23A.

Figure 4:
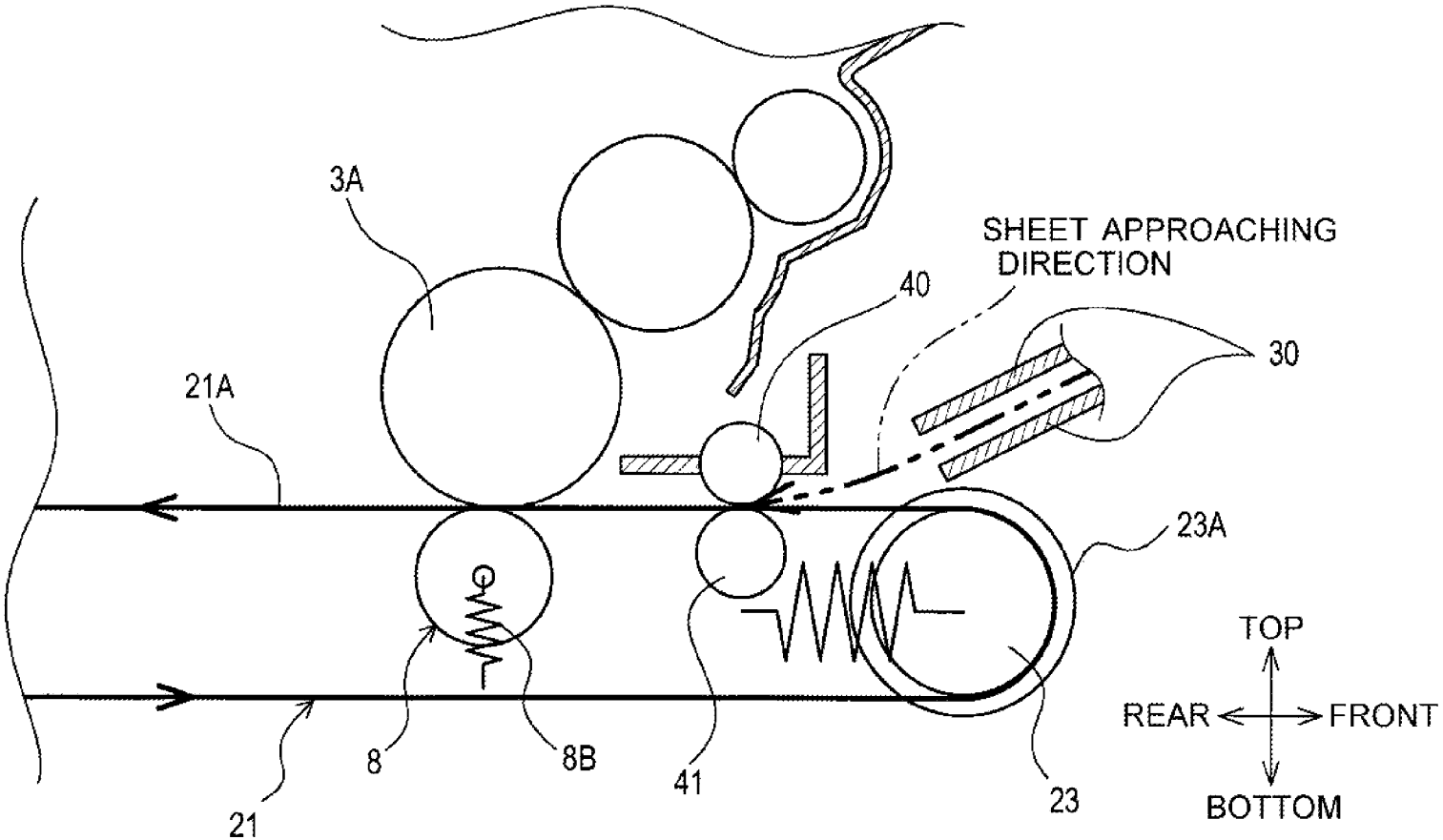
FIG. 4 is an enlarged view of a vicinity of a sheet guide of the image forming apparatus of FIG. 1, according to the first embodiment of the invention.

As shown in FIG. 4, a downstream end of the sheet guide 30 in the sheet conveying direction directs the sheet toward the extending surface 21A of the transfer belt 21 to a position between the transfer roller 8 and the driven roller 23. The transfer roller 8 described herein is the transfer roller disposed closest to the driven roller 23 than the other transfer rollers 8.

A charging member, e.g., a charging roller 40 is disposed downstream of the sheet guide 30 and upstream of the photosensitive drum 3A in the sheet conveying direction. The charging roller 40 electrically charges the sheet conveyed toward the transfer belt 21 such that the sheet is attracted to the transfer belt 21.

The charging roller 40 is disposed on the same side as the photosensitive drum 3A relative to the extending surface 21A and is configured to contact the sheet. A backup roller 41 is disposed opposite to the charging roller 40 via the extending surface 21A. A voltage is applied between the charging roller 40 and the backup roller 41 to charge the sheet.

Similarly to the transfer roller 8, the charging roller 40 comprises an elastic portion on its outer circumferential surface. The charging roller 40 and the backup roller 41 extend in the axial direction. Dimensions in the axial direction of the charging roller 40 and the backup roller 41 are substantially equal to the dimension in the width direction of the transfer belt 21.

The dimension in the axial direction of the charging roller 40 refers to a dimension in the axial direction of a roller portion thereof that contacts the sheet. The dimension in the axial direction of the backup roller 41 refers to a dimension in the axial direction of a roller portion thereof that opposes the roller portion of the charging roller 40.

As described above, in this embodiment, the transfer roller 8 and the photosensitive drum 3A oppose each other indirectly with the transfer belt 21 therebetween in the indirectly opposing area α and oppose each other directly without the transfer belt 21 therebetween in the directly opposing area β.

The dimension Wb in the width direction of the transfer belt 21 is less compared to the case where a transfer roller and a photosensitive drum oppose each other indirectly via a transfer belt which lies substantially throughout the axial dimensions of the transfer roller and the photosensitive drum.

Accordingly, material costs of the transfer belt 21 can be cut, and manufacturing costs of the image forming apparatus 1 comprising the transfer belt 21 can be reduced. In addition, in the above-described embodiment, the transfer belt 21 is a guideless belt not provided with a belt guide portion. The omission of a belt guide portion further reduces manufacturing costs.

As described above, in this embodiment, the dimension Wj in the axial direction of the driving roller 22 and the dimension Wd in the axial direction of the driven roller 23 are less than the dimension Wt in the axial direction of the transfer roller 8. The driving roller 22 and the driven roller 23, which are compact in size, can further reduce manufacturing costs.

As described above, in this embodiment, the image forming apparatus 1 comprises the flanges 23A for preventing skew of the transfer belt 21, and the sheet guide 30 defining the conveying path at a position outward from the flanges in their radial directions. The flanges 23A prevent the transfer belt 21 from skewing while the sheet guide 30 prevents the sheet from interfering with the flanges 23.

If the electrical resistance between the photosensitive drum 3A and the transfer roller 8 in the indirectly opposing area α differs greatly from that in the directly opposing area β, the transfer amount of developer in the indirectly opposing area α differs greatly from that in the directly opposing area β. This may cause uneven transfer of the developer image to the sheet in the axial direction.

In this embodiment, however, the volume resistance of the transfer belt 21 is set to be less than that of the sheet. This prevents the electrical resistance between the photosensitive drum 3A and the transfer roller 8 from differing greatly between the indirectly opposing area α and the directly opposing area β.

Consequently, noticeable uneven transfer of the developer image to the sheet can be reduced to thereby improve quality of the resulting image.

The volume resistance of the sheet having a thickness of approximately 100 μm is approximately $10^8\Omega$ to $10^{12}\Omega$. The volume resistance of the transfer belt 21 having a thickness of approximately 160 μm is approximately $10^6\Omega$ to $10^8\Omega$. These volume resistivities are values measured using the dual-ring electrode method which is a method for measuring electrical resistance prescribed in IEC60093, ASTM D257, MS K6911, JIS K6271, etc.

As described above, in this embodiment, the transfer roller 8 comprises the elastic layer 8A on its outer circumferential surface. The elastic layer 8A is compressed to reduce a clearance formed between the sheet and the transfer roller 8 at a border of the indirectly opposing area α and the directly opposing area β. This reduces uneven transfer of the developer image to the sheet due to the clearance between the sheet and the transfer roller 8 to thereby improve quality of the resulting image.

Figure 5:
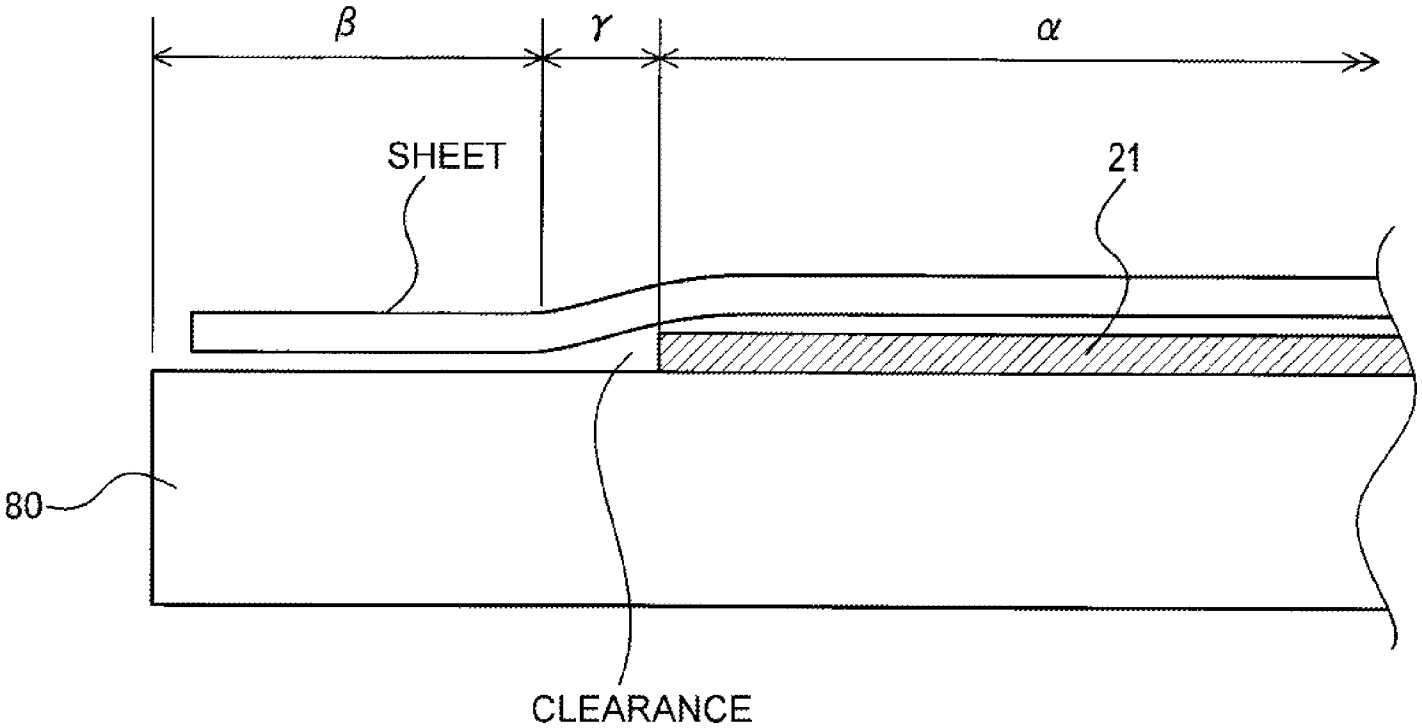
FIG. 5 is a schematic drawing showing positional relations among a sheet, a transfer belt, and a transfer roller, according to another embodiment of the invention.

In another embodiment, as shown in FIG. 5, a transfer roller 80 may comprises a non-elastic layer on the outer circumferential surface thereof, instead of the elastic layer 8A. In this case, however, as shown in FIG. 5, a relatively large clearance, i.e., an air layer, may be formed between the sheet and the transfer roller 80 at a border γ of the indirectly opposing area α and the directly opposing area β.

The electrical resistance of the border γ is greater than that of the indirectly opposing area α and that of the directly opposing area β, and this may hinder the flow of electric current for transfer at the border γ and may cause noticeable uneven transfer of the developer image to the sheet.

In the above-described embodiment, the charging roller 40 is provided to charge the sheet conveyed toward the transfer belt 21 and to cause the sheet to be attracted to the transfer belt 21. Consequently, the sheet can be properly conveyed.

Figure 6:
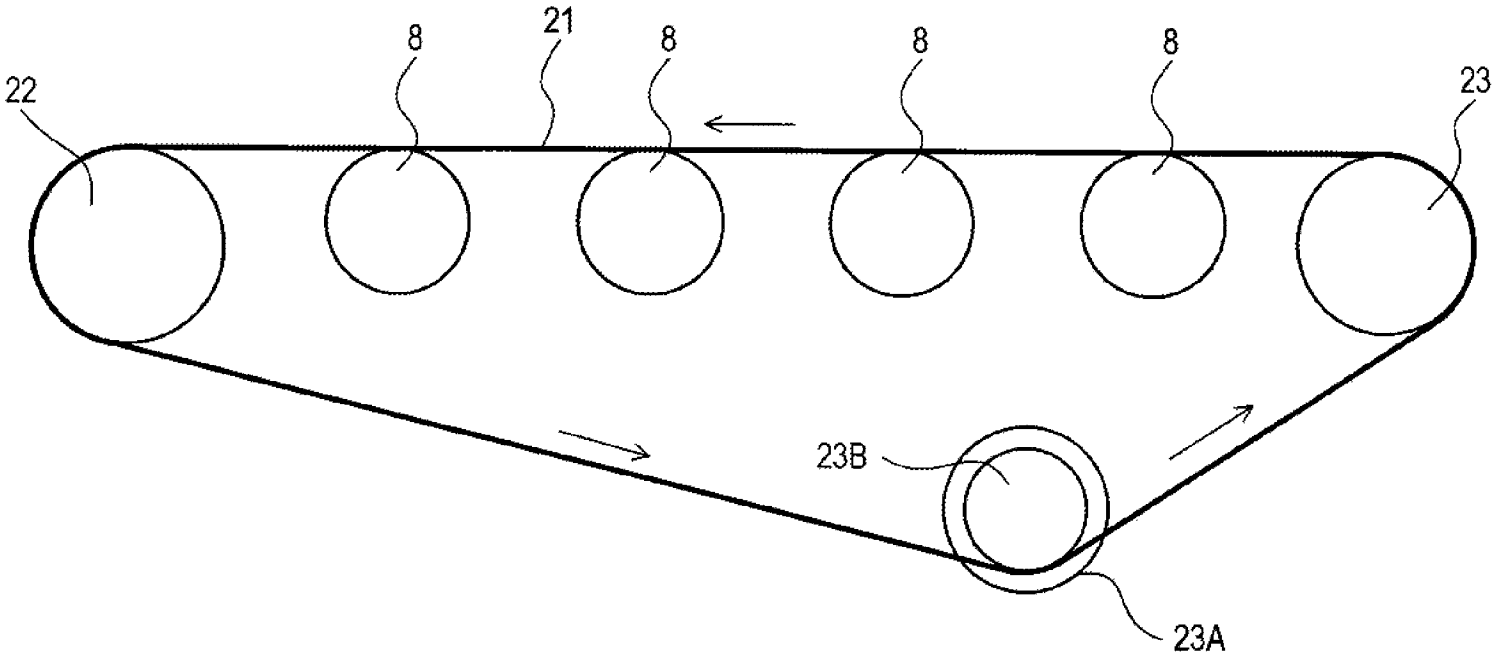
FIG. 6 is a schematic drawing of an image forming apparatus according to a second embodiment of the invention.

In the above-described first embodiment, the transfer belt 21 is held by the driving roller 22 and the driven roller 23. In a second embodiment, as shown in FIG. 6, a tension roller 23B for causing a transfer belt to generate tension is provided in addition to a driving roller 22 and a driven roller 23 such that a transfer belt is held by the three rollers 22, 23, 23B. The tension roller 23B comprises flanges 23A for preventing skew of the transfer belt 21.

Another roller instead of the tension roller 23B, in addition to the driving roller 22 and the driven roller 23, may hold the transfer belt 21. Any one of the rollers 22, 23 other than the tension roller 23B may comprise the flanges 23A.

Figure 7:
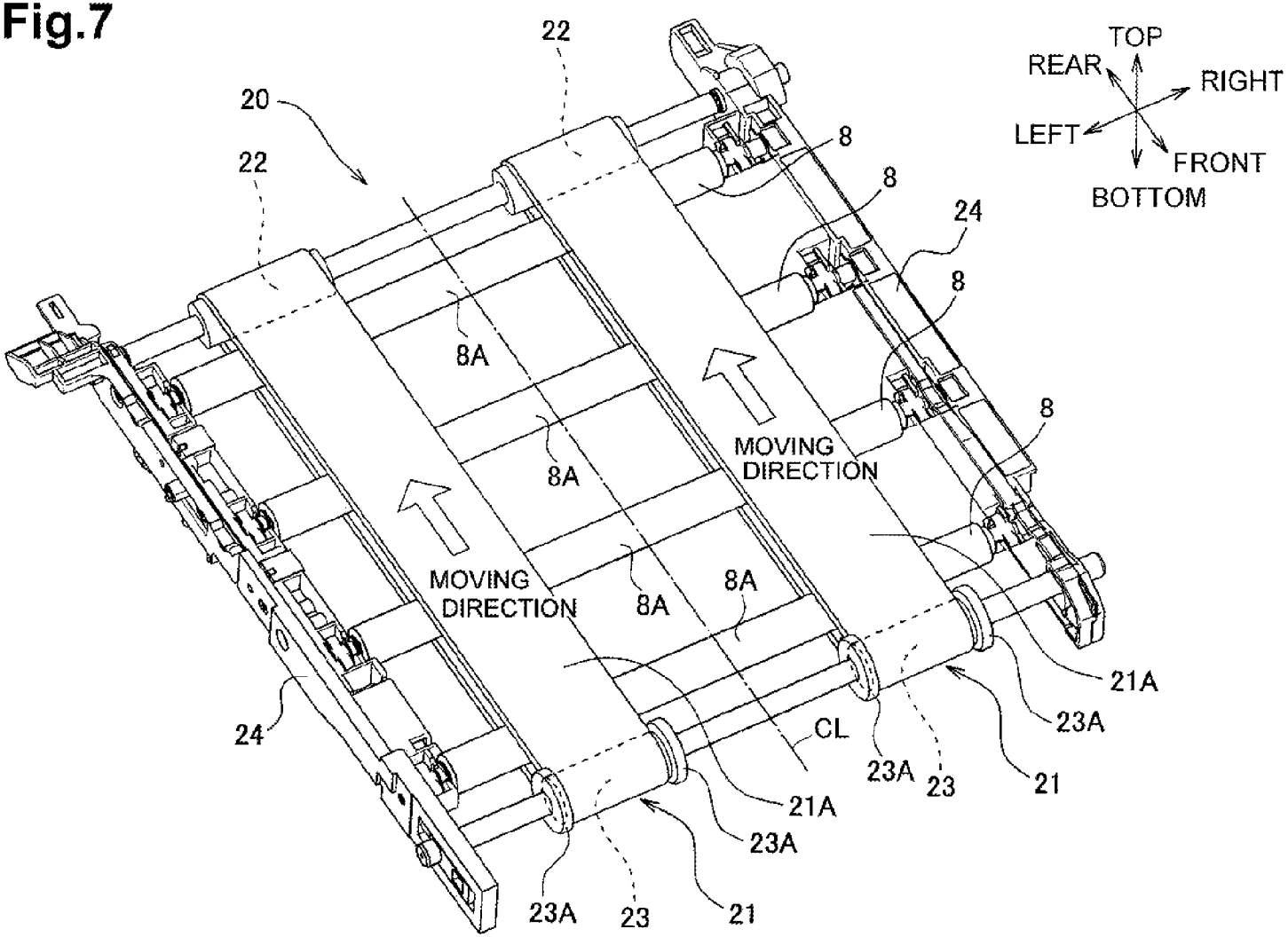
FIG. 7 is a schematic drawing of an image forming apparatus according to a third embodiment of the invention.

In the first embodiment, a single transfer belt 21 is used. In a third embodiment, as shown in FIG. 7, two or more transfer belts 21 may be used. The total dimension in the width direction (e.g., total width) of the two or more transfer belts 21 is set to be less than the dimension in the width direction of a sheet of the maximum size and the dimension in the axial direction of the transfer roller 8 (e.g., width of the transfer roller 8), such that indirectly opposing area(s) α and directly opposing area(s) β are defined. The two transfer belts 21 are disposed symmetrically with respect to a center line CL passing a center in the axial direction of the transfer roller 8. The center line CL is illustrated in FIG. 7 as a dashed line.

Figure 8:
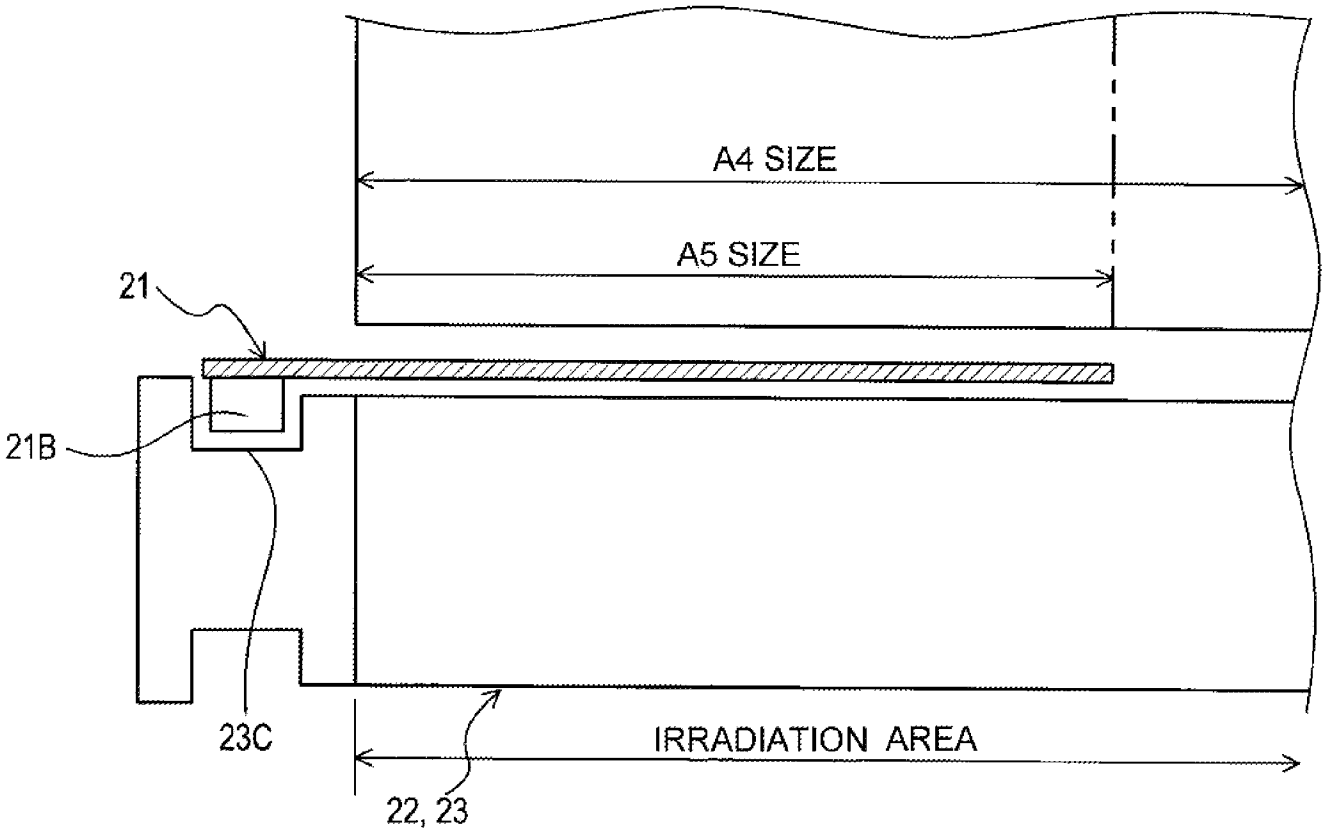
FIG. 8 is a schematic drawing of an image forming apparatus according to a fourth embodiment of the invention.

In the first embodiment, a guideless belt is used as the transfer belt 21. In a fourth embodiment, as shown in FIG. 8, a transfer belt 21 may be provided with a guide rib 21B. The guide rib 21B is disposed on an inner surface of the transfer belt 21 and at a widthwise end portion of the transfer belt 21. The guide rib 21B is integrally attached to the transfer belt 21 using an adhesive and a double-sided tape.

The guide rib 21B is a guide portion protruding from the inner surface of the transfer belt 21 and extending along a circulating direction of the transfer belt 21. A driving roller 22 and a driven roller 23 each have a guide groove 23C configured and dimensioned to receive the guide rib 21B. The guide rib 21B receiving the guide grooves 23C prevents skew of the transfer belt 21. Thus, the flanges 23A are omitted in this embodiment.

In the fourth embodiment, the sheet is conveyed while being aligned with reference to an end position in the axial direction of the driving roller 22 and the driven roller 23, and the transfer belt 21 is disposed to one side in the axial direction. The guide rib 21B and the guide grooves 23C are positioned outside an irradiation area of a photosensitive drum. Thus, the guide rib 21B and the guide grooves 23C will not adversely affect the transfer of a developer image on the photosensitive drum to a sheet.

Figure 9:
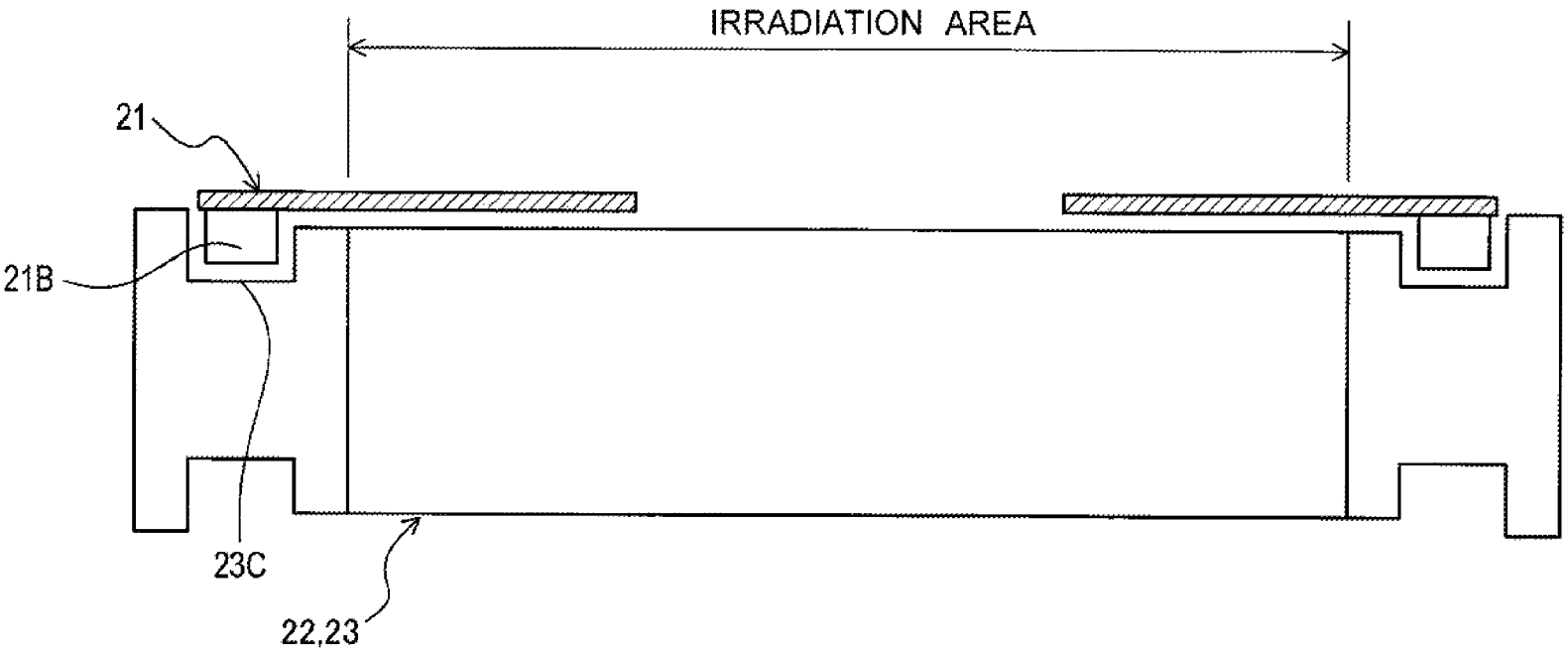
FIG. 9 is a schematic drawing of an image forming apparatus according to a fifth embodiment of the invention.

In a fifth embodiment, which is a modification of the fourth embodiment, two transfer belts 21 are disposed to two opposite sides in the axial direction, respectively, as shown in FIG. 9. In this embodiment, a sheet is conveyed while being aligned with reference to a center in the axial direction. Each guide rib 21B and a corresponding guide groove 23C, which are disposed outside an irradiation area of a photosensitive drum in the axial direction, will not adversely affect the transfer of a developer image on the photosensitive drum to a sheet.

In the fifth embodiment, the total dimension in the width direction of the two transfer belts 21 are set to be less than the dimension in the width direction of a sheet of the maximum size and the dimension in the axial direction of the transfer roller 8, such that an indirectly opposing area α and a directly opposing area β are provided.

Figure 10A:
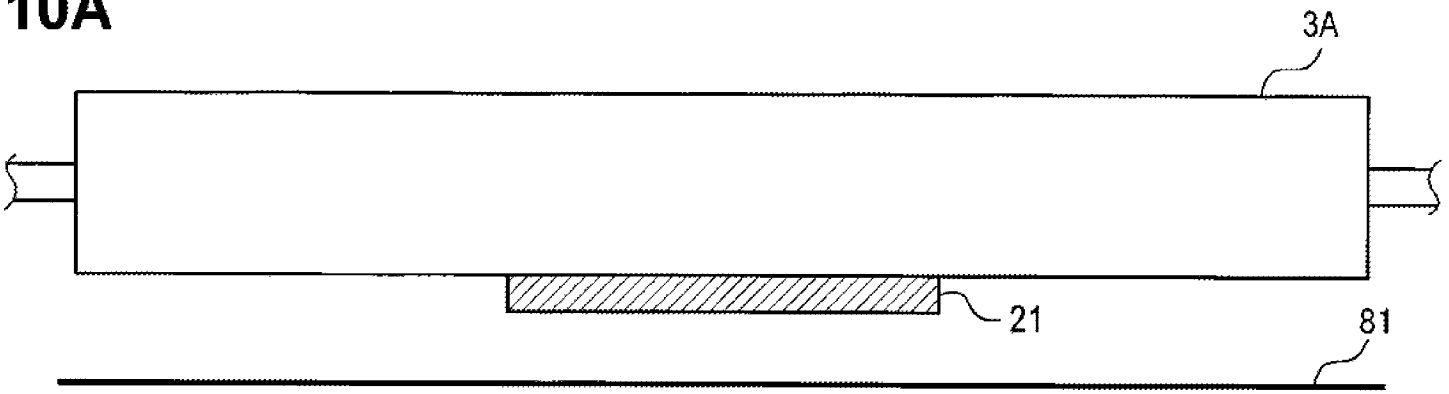
FIG. 10A is a schematic drawing of a transfer member formed by a transfer wire, according to a sixth embodiment of the invention.

Although, in the first embodiment, the transfer roller 8 serves as a transfer member, the transfer member may not be a roller. In a sixth embodiment, as shown in FIG. 10A, a transfer wire 81 serves as the transfer member. The transfer wire 81 extends in the axial direction of a photosensitive drum 3A while being not in contact with a transfer belt 21 and a sheet being conveyed.

Figure 10B:
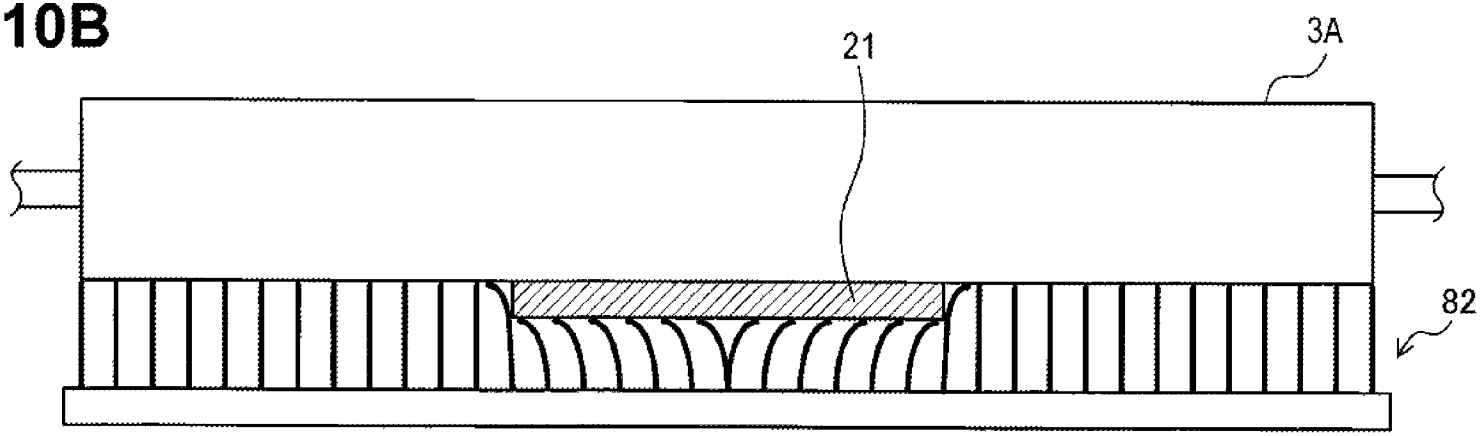
FIG. 10B is a schematic drawing of a transfer member formed by a transfer brush, according to a seventh embodiment of the invention.

In the seventh embodiment, as shown in FIG. 10B, a transfer brush 82 serves as the transfer member. Ends of brush fibers of the transfer brush 82 are configured to contact a transfer belt 21 and a sheet being conveyed.

Although, in the first embodiment, the driven roller 23 comprises the flanges 23A, the driving roller 22 may comprise flanges.

Although, in the first embodiment, the flanges 23A and the sheet guide 30 are dispose upstream of the extending surface 21A in the sheet conveying direction, the flanges 23A and the sheet guide 30 may be disposed downstream of the extending surface 21A in sheet conveying direction.

Although, in the first embodiment, the driven roller 23 is disposed upstream of the extending surface 21A in the sheet conveying direction, the driven roller 23 may be disposed downstream of the extending surface 21A in the sheet conveying direction.

Although, in the first embodiment, the belt unit 20 is removably attached to the main body of the image forming apparatus 1, the driving roller 22 and the driven roller 23 or the like may be directly and unremovably attached to the main body of the image forming apparatus 1.

Although, in the above-described embodiments, the flanges 23A or the guide rib 21B are used to prevent skew of the transfer belt 21, other methods for preventing skew of the transfer belt 21 may be used.

Although, in the first embodiment, the invention is applied to the color image forming apparatus, the invention may be applied to a monochrome image forming apparatus.

Although, in the first embodiment, the photosensitive drum 3A having a roller shape is used as the image supporting member, and the transfer roller 8 is used as the transfer member, the invention is not limited to the embodiment disclosed.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image forming apparatus comprising:

a first roller configured to rotate about an first axis extending in an axial direction;

a second roller configured to rotate about a second axis extending in the axial direction;

a belt held by the first roller and the second roller and configured to convey a sheet, the belt being endless, having a first surface and a second surface opposite to the first surface, and having a width in a direction parallel to the axial direction;

an image supporting member extending in the axial direction and configured to support a developer image;

a transfer member disposed opposite to the image supporting member with the belt therebetween and configured to transfer the developer image supported by the image supporting member to the sheet conveyed by the belt, the transfer member having a width in a direction parallel to the axial direction, and the transfer member comprising a roller which comprises an elastic layer on an outer circumferential surface of the roller; and an urging member, wherein under application of an urging force by the urging member, a first portion of the image supporting member and a first portion of the elastic layer of the transfer member are in contact with each other without the belt therebetween, a second portion of the image supporting member is in contact with the first surface of the belt, and a second portion of the elastic layer of the transfer member is elastically deformed by the second surface of the belt.

2. The image forming apparatus according to claim 1, further comprising a sheet holder configured to hold the sheet to be fed to the belt, the sheet holder having a width in a direction parallel to the axial direction and configured to have a maximum sheet width size, wherein the width of the belt is less than the maximum sheet width size of the sheet holder.

3. The image forming apparatus according to claim 1, wherein the width of the belt is less than the width of the transfer member.

4. The image forming apparatus according to claim 1, wherein the belt comprises a guide rib extending parallel to a moving direction of the belt, and the first roller and the second roller each have a guide groove configured and dimensioned to receive the guide rib.

5. The image forming apparatus according to claim 1, wherein a dimension in the axial direction of at least one of the first roller and the second roller is less than the width of the transfer member.

6. The image forming apparatus according to claim 1, wherein the first roller comprises:

a roller portion; and a pair of flanges each protruding outward from the roller portion in a radial direction of the first roller and each configured to contact a corresponding one of edges of the belt and to prevent the belt from moving in the axial direction, and wherein the image forming apparatus further comprises a sheet guide configured to guide the sheet to a position above the belt and more outer in the radial direction than the pair of flanges.

7. The image forming apparatus according to claim 6, wherein the first roller is disposed upstream of the second roller in a sheet conveying direction which is perpendicular to the axial direction of the first roller, and wherein the sheet guide is configured to direct the sheet toward the belt to a position between the first roller and the transfer member in the sheet conveying direction.

8. The image forming apparatus according to claim 1, wherein a volume resistance of the belt is less than a volume resistance of the sheet.

9. The image forming apparatus according to claim 1, wherein the urging member urges the transfer member against the image supporting member.

10. The image forming apparatus according to claim 1, further comprising a charging member configured to electrically charge the sheet whereby the sheet is attracted to the belt.

11. An image forming apparatus comprising:

a first roller configured to rotate about an first axis extending in an axial direction;

a second roller configured to rotate about a second axis extending in the axial direction;

a first belt held by the first roller and the second roller and configured to convey a sheet, the first belt being endless, having a first surface and a second surface opposite to the first surface, and having a width in a direction parallel to the axial direction;

a second belt held by the first roller and the second roller and configured to convey the sheet, the second belt being endless and having a width in a direction parallel to the axial direction;

an image supporting member extending in the axial direction and configured to support a developer image; and a transfer member disposed opposite to the image supporting member with the first belt and the second belt therebetween and configured to transfer the developer image supported by the image supporting member to the sheet conveyed by the first belt and the second belt, the transfer member having a width in a direction parallel to the axial direction, wherein a total width of the first belt and the second belt is less than the width of the transfer member, and wherein a first portion of the image supporting member and a first portion of the transfer member directly oppose each other without the first belt therebetween, a second portion of the image supporting member opposes the first surface of the first belt, and a second portion of the transfer member opposes the second surface of the first belt.

12. The image forming apparatus according to claim 11, wherein the first belt and the second belt are disposed symmetrically with respect to a center line passing a center in the width of the transfer member.

* * * * *